United States Patent [19]

Jaconette

[11] 4,193,660

[45] Mar. 18, 1980

[54] ELECTRICAL CONTACT ASSEMBLY

[75] Inventor: Frank C. Jaconette, Trumbull, Conn.

[73] Assignee: Harvey Hubbell, Incorporated, Orange, Conn.

[21] Appl. No.: 969,730

[22] Filed: Dec. 15, 1978

Related U.S. Application Data

[63] Continuation-in-part of Ser. No. 875,212, Feb. 6, 1978, abandoned.

[51] Int. Cl.[2] ..... H01R 13/12

[52] U.S. Cl. ..... 339/191 R; 339/258 R

[58] Field of Search ..... 339/65, 66, 191, 192, 339/176 MP, 217 R, 258 R, 258 P

[56] References Cited

U.S. PATENT DOCUMENTS

| | | | |
|---|---|---|---|
| 2,384,273 | 9/1945 | Beal | 339/258 P |
| 3,041,570 | 6/1962 | Simerl | 339/217 R |
| 3,178,669 | 4/1965 | Roberts | 339/217 S |
| 3,391,374 | 7/1968 | Schleicher | 339/14 R |

FOREIGN PATENT DOCUMENTS

| | | | |
|---|---|---|---|
| 2135508 | 1/1973 | Fed. Rep. of Germany | 339/258 R |
| 1280105 | 7/1972 | United Kingdom | 339/176 MP |

*Primary Examiner*—Joseph H. McGlynn

*Attorney, Agent, or Firm*—Jerry M. Presson

[57] ABSTRACT

A female contact has at least one contact arm with an outwardly diverging tip end for guiding the tip of a male blade inserted into the contact. A contact arm abutment is mounted on a contact chamber sidewall and projects inwardly into the chamber. The abutment is aligned with an elongated contact arm of the female contact and is spaced outwardly from that arm to set the limit of acceptable outward contact arm deflection. A portion of the contact arm extending rearwardly from the diverging tip end is channeled to allow this end to clear the abutment when the contact is inserted longitudinally into the chamber from the rearward end thereof. The abutment limits outward displacement of the contact arm to prevent the overstressing of the arm by an engaging male blade and in a preferred embodiment, is formed as a unitary part of the pocket sidewall.

28 Claims, 11 Drawing Figures

ELECTRICAL CONTACT ASSEMBLY

REFERENCE TO RELATED APPLICATION

This application is a continuation-in-part of patent application Ser. No. 875,212, filed Feb. 6, 1978, now abandoned.

INTRODUCTION

This invention relates to electrical terminals and more particularly to female electrical contact assemblies for use in electrical wiring devices.

BACKGROUND OF THE INVENTION

Female electrical contact assemblies find application in various types of electrical terminals that are used in various types of electrical devices, such as electrical receptacles. These contact assemblies typically include a plurality of individual contact pockets or chambers molded in the insulated body forming the electrical device housing. Mounted fixedly within each pocket is a female contact.

The female contact is typically constructed of a substantially flat base portion mounted in a rearward end of the contact pocket and two elongated, opposing contact arms cantilevered from the base portion. These contact arms extend forwardly toward a frontward opening in the pocket through which an elongated male blade contact member may be inserted. The contact arms are spaced apart at their forwardmost ends, which are located slightly rearwardly of the blade opening, to receive and retain the male blade contact longitudinally therebetween. The base portion is usually made part of an electrical terminal or a conductive member and the opposing spring contact arms are respectively inclined inwardly from the base member toward the longitudinal axis of the pocket, and then outwardly, to form a "knee" region near the free ends of the contact arms where the lateral spacing between the opposing arms is less than the width of the male contact blade. The arms extending forwardly from the knee region diverge or flare outwardly to provide mutually divergent forward tip surfaces for directing the tip of the male blade into the knee region and rearwardly thereof toward the base portion.

The male blade opening at the frontward end of the contact pocket is substantially centered on the longitudinal axis of the contact pocket and for various reasons known to those working in the art, conforms closely in both size and configuration to the size and cross-sectional configuration of the male contact blade. On the other hand, to provide the desired clearance for the outward displacement of the female contact arms, the cross-sectional area of the interior sidewalls of the contact pocket is necessarily considerably larger than the corresponding area of the male blade opening. Hence, the rearward opening to the wiring pocket may be molded much larger than the male blade opening thereby providing easier access for inserting a female contact into the pocket. Moreover, certain other conductive parts comprising the electrical device to which the female contact is mounted prior to assembly in the device housing such as the mounting yoke or conductive strap of an electrical receptacle, are typically located on the rearward surface of the electrical device adjacent the rearward end of the contact pocket. For ease of assembly, it is preferred that the female contact be placed in the housing by inserting it through an opening at the rearward end of the contact pocket. When properly mounted, the diverging female tips of each contact required by the receptacle are located slightly behind and in substantial longitudinal alignment with the corresponding male blade opening.

To provide good electrical contact with, and retention of, a male blade inserted into the female contact, the knee portions of the female contact are spaced slightly closer than the corresponding width of the male blade. With this arrangement, the free tips of the contact arms are displaced outwardly upon insertion of the male blade into the knee region.

The longitudinal movement of the male blade contact between the contact arms sometimes does not occur in the optimum longitudinal plane which passes symmetrically or midway between the opposite knee portions of the contact arms. Rather, the male blade may be inserted or withdrawn at a substantial angle with respect to this plane causing the male blade tip to bear against and drive portions of an opposing female contact blade arm outwardly toward, and in some extreme instances, against an opposing pocket sidewall. To lessen the possibility of this occurring, the portion of each contact arm rearwardly of the knee region is inclined outwardly to provide a greater lateral spacing between the contact arms in the vicinity of the contact base portion where contact with the blade tip is likely to occur.

Since the rearward end of the female contact arm is constrained against lateral movements by the fixed base portion from which it extends and a corresponding excessively deflected diverging tip will abut the opposing pocket sidewall, analyzed from a strength of materials standpoint, the contact arm is equivalent to a beam of rectangular cross-sectional shape fixed at one end (the base end), and supported at the other end (the tip end). Accordingly, depending upon such factors as the modulus of elasticity of the contact arm, the extent to which lateral displacement of a stressed portion of the arm is permitted by the contact pocket sidewall and the directions and magnitudes of the stresses produced in the arm by the male blade bearing thereagainst, the stresses developed in the contact arm may exceed the elastic yield point of the metal of which the arm is composed causing the highly stressed arm section to take a permanent set in its outwardly distorted position. In some cases, this can result in an increase in the lateral spacing between the contact arms in the knee region from the optimum spacing required for blade retention. Moreover, this condition can cause problems where good electrical continuity is a requirement for the optimum electrical performance of the contact assembly. The maintaining of proper contact pressures to ensure that electrical continuity exists at all times in the connection is extremely important in those cases where the male member is a grounding blade and the female contact is the grounding contact of an electrical wiring device.

The prior art has sought to prevent permanent distortion of the female contact by employing different techniques summarized briefly hereinbelow.

One prior art technique is to use special metal alloys in the contact arms, such as phosphor-bronze alloys, which possess substantially higher yield points than conventional brass alloy contact compositions so that the contact arms do not take a permanent set regardless of the degree to which they are distorted by the male blade. The disadvantage with this approach is that these higher yield point contacts are considerably more expensive that the conventional brass alloy compositions which otherwise possess all of the desired electrical conductivity properties for contact applications. Hence, a principal disadvantage in using the higher yield point alloys is that they add considerably to the cost of the device without appreciably improving the electrical performance of the contact assembly. In fact, in most cases, marginally lower conductivity is obtained with the special alloys. Also, as a practical matter, it presents a burden on the terminal device manufacturer to sample and qualitatively anaylyze the specially alloyed stock material to ensure that it has the desired alloy composition and deflection characteristics.

Another technique involves restraining the outward deflection of the contact arms by employing discrete deflection restraints attached to the arms during or after terminal assembly. Prior art restraints of this type include clip elements which clamp around the contact arms and extend from the knee region rearwardly to restrain the arms when they are displaced outwardly from one another more than a predetermined amount and unyielding ring elements which are placed over portions of the arms to inhibit the outward displacement thereof under the pressure of the male contact.

One disadvantage with the ring type of restraining devices is that they normally do not extend much beyond the knee region rearwardly of the contact arms and therefore, portions of the arms extending rearwardly of the knee region can still be distorted and overstressed by a tilted male blade tip bearing hard against those portions as it is inserted into or withdrawn from between the contact arms. While the clip elements do overlay rearward portions of the arms, these devices, as well as the ring devices, increase the cost of the device assembly and increase the inventory of parts required to be stocked by the terminal manufacture. Moreover, both of these types of devices create handling problems when they are fed into automatic assembling machines. Further, because they are not an integral part of the contact arms or the contact pocket, there is always the possibility that a device may be inadvertently omitted or lost in the assembly process. For these reasons, these restraining devices have not provided a completely satisfactory solution to the problem of preventing the contact arms from being overstressed.

A third technique involves restraining the outward deflection of the contact arms by the use of a resilient restraining device mounted on one or more sidewalls of the wiring pocket. Prior art devices of this type include resilient bumper pads or coil springs interposed between a pocket sidewall and an opposing portion of a contact arm. In general, these devices have the same disadvantages as the restraining type of device which is placed over one or both of the contact arms and therefore, have also not proven to be a satisfactory solution to the problem of preventing overstressing of the contact arms.

Another prior art technique is to use supplementary leaf springs mounted so as to provide additional strength to the contact arms to keep the stresses below the yield point of the contact material. Usage of these devices, however, also adds to the cost of the device and the installation and proper performances of such springs is not easy for the device manufacturer to provide and ensure.

SUMMARY OF THE INVENTION

According to this invention, there is provided a new and improved female contact assembly. The assembly includes the pocket of an electrically insulated terminal housing in which a female contact is mounted. The female contact has at least one contact arm with an outwardly diverging tip end for guiding the tip of a male blade inserted into the contact. A contact arm abutment is mounted on a sidewall defining the contact pocket and projects inwardly into the pocket. The abutment is longitudinally aligned with an elongated contact arm of the female contact and the abutment is spaced outwardly from that arm to set the limit of acceptable outward contact arm deflection. A portion of the contact arm extending from the diverging tip end is channeled to allow this end to clear the abutment when the contact is inserted longitudinally into the pocket from the rearward end thereof. The abutment limits outward displacement of the contact arm to prevent the overstressing of the arm by an engaging male blade and in a preferred embodiment is formed as a unitary part of the pocket sidewall.

The instant invention allows the wiring device manufacturer to use standard brass alloy compositions in his contacts and obviates the above-summarized problems attendant with the use of special deformation resisting contact alloys and conventional displacement restraints.

OBJECTS OF THE INVENTION

It is an object of this invention to provide a new and improved female terminal assembly which overcomes many of the disadvantages of prior art assemblies.

More specifically, it is an object of this invention to provide a female contact assembly wherein the outward deflection of the female contact is limited by means which is a unitary part of the assembly.

Another object of this invention is to provide a female contact assembly having a cantilevered contact arm mounted in a contact pocket, wherein outward deflection of a contact arm is limited by an abutment formed integral with the pocket and extending into the pocket inwardly of the outermost portion of the contact arm.

Yet another object of this invention is to provide a deflection limiting element as a unitary part of a female contact chamber, the element projecting inwardly of the outermost flared tip portion of a female contact arm in the chamber and extending over a substantial part of the length of the contact arm to inhibit permanent distortion thereof by an abutting male contact member.

DETAILED DESCRIPTION

Figure 1:
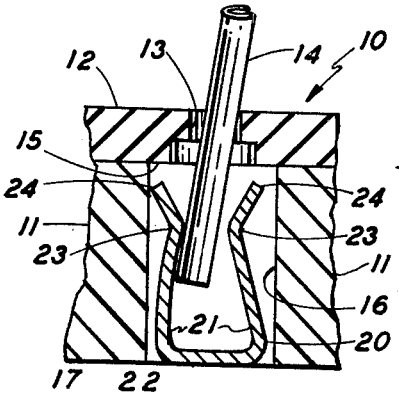
FIG.1 (PRIOR ART)
FIG. 1 is a sectional side view along a longitudinal plane passing through both arms of a conventional contact terminal assembly to illustrate how a female contact may be permanently distorted by a male blade in such assembly.

With reference to FIG. 1 of the drawings, there is shown a typical prior art female contact assembly embodied in a suitable electrical terminal device, such as an electrical receptacle. The female contact is accommodated in the insulated pocket 16 defined by a plurality of flat, spaced-apart opposing sidewalls 11. The sidewalls are usually composed of the same electrical insulating material used to fabricate the electrical device embodying the contact assembly. This material is usually a thermosetting material but may also be a thermoplastic material.

Covering the front end of the pocket is a flat wall member 12 having a male contact blade opening 13 extending perpendicularly therethrough. The member 12 is also composed of an electrical insulating material with good wear-resistant characteristics, such as nylon, and may be attached to the front end of the pocket by adhesives or suitable attachment devices or molded as an integral part of the pocket sidewalls. The opening is centered on the longitudinal axis of symmetry of the pocket and typically is configured to accept only an appropriate elongated male blade contact, designated generally by the numeral 14, while inhibiting the entry of contacts of non-compatible electrical devices. As mentioned hereinabove, the male contact blade may be the relatively longer ground blade of a three-blade electrical plug which is to be inserted into a female receptacle wiring device.

The rearward end 17 of the contact terminal pocket is usually of greater cross-sectional area than that of the opening 13 and, for manufacturing reasons, is normally the end into which a conventional female contact 20 is inserted.

The contact 20 may be affixed at its rearward end or edge 22 to an elongated metal element (not shown) that is transversely apertured and internally threaded to receive a terminal mounting screw (not shown). The electrical lead which is connected to the contact 20 is placed under this mounting screw and the screw tightened down to effect an electrical connection therebetween. Alternatively, the end 22 may be detachably affixed to, or made an integral part of, a conductive strap or yoke which provides an electrical circuit path, such as a grounding path between the contact and other parts of the device on which the contact is mounted.

As mentioned hereinabove, female contacts may be formed of various metallic compositions but it is usually preferred that conventional brass alloy compositions be used because of their wide availability, low cost and relatively good electrical and spring properties.

Two spaced apart, opposing arms 21 of the contact 20 extend frontwardly, and inwardly toward the longitudinal axis of the pocket 16, from the end 22 to a point near the optimum region for making electrical contact with the male blade. This region is formed by the opposing knees 23 of the contact arm. In the illustrated contact 20, the contact arms 21 are designed to be symmetrical about the axis of symmetry of the contacts or the optimum axis of blade insertion. However, the contact arm 21 shown as the left contact arm in FIG. 1 is depicted in a distorted shape to illustrate the condition which results in the knee region when permanent distortion occurs. In the knee region, the lateral spacing between the knee portions 23 is closest and in the normal situation, is slightly less than the width of the male contact blade to provide good electrical contact and the desired retentive forces with the male blade 14.

The frontward tip 24 of each contact arm 21 diverges outwardly from its corresponding knee region 23 to a position inwardly of its adjacent sidewall 11 and slightly rearwardly of the opening 13. The tips 24 are flared outwardly to provide mechanical guidance of the male blade tip so that the blade tends to be advanced along the longitudinal axis of symmetry of the contact into and between the symmetrically opposing knee portions 23.

As will be evident from FIG. 1, the contact blade 14 may be tilted at an acute angle with respect to the longitudinal axis of the contact or its optimum axis of insertion upon its insertion into or its withdrawal from the terminal assembly. With one edge bearing against an underlying part of the cover 12, the tip of the blade 14 is fulcrumed to bear forcibly against one of the adjacent contact arms 21 causing an outward displacement and stressing of the contact arm portion against which the blade tip presses. If this contact arm portion is stressed until the yield point of the material composition of the arm is exceeded, the distortion will take a permanent set and prevent the arm from returning to its proper initial position. This condition is depicted in FIG. 1 as having occurred to the left arm 21. Once permanent distortion occurs, the spacing at the knee region may be greater than desired to provide the desired electrical connective and blade retentive forces to the male blade 14 and could result in a loss of electrical continuity between the female and male contacts.

Figure 2:
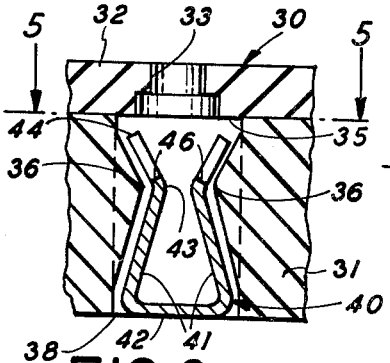
FIG. 2 is a sectional side view along a longitudinal plane passing through both arms of a female contact terminal assembly constructed in accordance with the principles of this invention.

This problem is overcome by the contact assembly constructed in accordance with this invention; one embodiment thereof being illustrated in FIG. 2. In FIG. 2, the assembly 30 is shown as comprising a front cover portion 32 having the conventional opening 33 for accommodating the male blade contact. The front cover 32 covers the contact pocket formed by two flat, mutually opposing sidewalls 31 which accommodate therebetween a contact 40 constructed in accordance with the principles of this invention. The sidewalls 31 have a pair of rib-like abutments 36 of rectangular cross-section which extend inwardly into the pocket from the sidewalls. The width dimension of each abutment is about one-third the width of the opposing contact arm.

Figure 5:
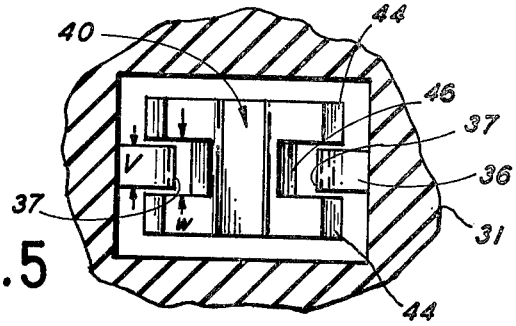
FIG. 5 is a sectional plan view taken along section lines 5—5 of FIG. 2.

The abutments 36 are located opposite one another so as to underlie a length of the outside surface of a respective one of contact amrs 41 depending from contact base 42. The knee region of the contact is the area between the mutually opposing knee portions 43 of the contact arms. Since those portions of the arms 41 extending between the base 42 and the knees 43 are inclined inwardly, toward the longitudinal axis of the pocket, at an acute angle to the plane of the adjacent sidewall 31, in order to substantially follow along side the adjacent outer surfaces of the contact arms, the edges 37, FIG. 5, of the abutments 36 are similarly inclined inwardly at an acute angle with respect to the plane of their adjacent sidewalls commencing at or near the rearward end 38 of the pocket.

The abutments 36 are preferably molded integral with the contact pocket during the molding process and the edges 37 are each spaced outwardly from the outer surface of an adjacent contact arm a given distance which will allow a predetermined amount of outward displacement of either or both of the contact arms necessary for the desired electrical and mechanical operation of the particular assembly. Once this amount of displacement is attained, the affected portions of the contact arms abut the edges 37 and are prevented by the contacted abutment from being displaced any further. The abutments thereby prevent the contact arms from taking a permanent set in a distorted position.

One principal advantage of having the abutments 36 formed integral with the pocket is that the entire cavity may be molded easily in a simple, two piece mold and once formed as an integral part of the pocket, the abutments cannot be omitted during manufacture of the contact assembly. Since the contact arms 41 are inclined inwardly from their base 42 to provide a contact region between knee portions 43 and since the tips 44 of the contact arms diverge outwardly from the knee portions 43, the abutments 36 will extend inwardly of the outer ends of the tips 44 in order to provide the desired contact displacement limiting surfaces.

For reasons discussed hereinabove, it is usually desired to insert the contact 40 into the pocket from the rearward end of the pocket rather than through the opening 33. However, since the tips 44 extend outwardly of interior edges 37 of the abutments, particularly in the knee region of the pocket, the tips would be blocked by the abutments before the contact 40 could be fully inserted into the contact pocket. It will be appreciated that were the contact not channeled, the tips of the contact arms would have to be compressed inwardly to clear the abutment. The stresses created in the contact arms to effect the necessary clearance could cause overstressing of the contact arms.

This problem is solved in accordance with the principles of this invention by having the tips of the contact arms and the abutments constructed so as to allow the tips to pass the abutments when the contact is inserted or removed from the pocket. This arrangement leaves the tips with sufficient surface structure to guide the male blade properly between the opposing tips and provide the desired electrical contact therebetween.

In accordance with the embodiment illustrated in FIG. 2, the abutment is a rib-like member throughout its length and the tips of the contacts are channeled to conform to the configuration of the abutment. As will be apparent, this invention permits the contact manufacturer to utilize conventional brass contacts since the adaption of these contacts to the abutments may be readily and inexpensively effected by merely blanking slots of appropriate width and depth into the tips of these contacts.

Figure 6:
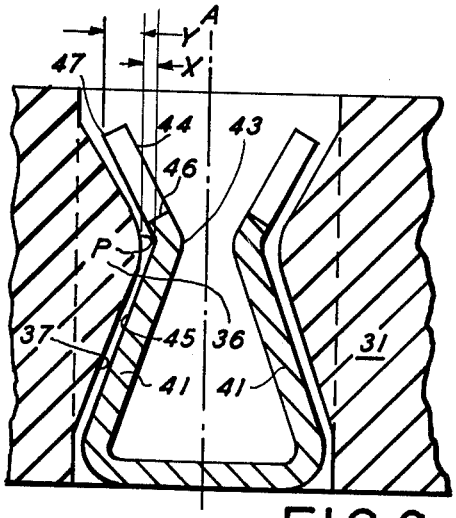
FIG. 6 is an enlarged view of the female contact terminal assembly illustrated in FIG. 2 with the front cover removed.
Figure 7:
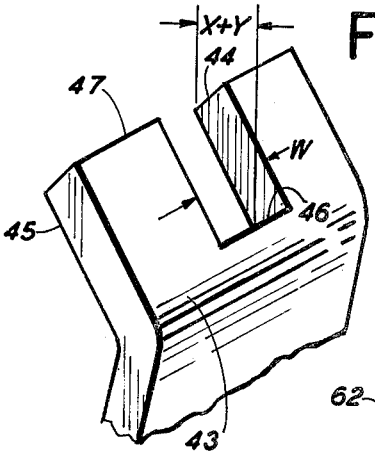
FIG. 7 is an isometric view of the frontward end of the left arm of the female contact shown in FIG. 6.
Figure 8:
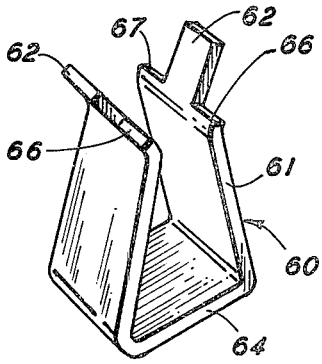
FIG. 8 is an isometric view of the female contact embodiment depicted in FIG. 3.

For a given contact arm and an associated abutment, the depth of the channel can be determined with reference to FIGS. 6 and 7. The length of the channel is the distance along the plane of the tip 44 from the outermost surface 47 of the tip 44 to the bottom edge 46 of the channel. The term X is assmed to be the distance between the innemost point P of the abutment 36 and the back of the knee 43 taken perpendicular to the axis of symmetry A—A. The term Y is assumed to be the distance perpendicular to the axis A—A between the outermost edge of the surface 47 and the point P. The dimension X is the dimension of the maximum desired displacement which is permitted of the contact arm. To ensure that the contact tip 44 will clear the abutment with this dimension fixed, the length of the rectangular channel between the edges 47 and 46 must be at least equal to X plus Y and this dimension can be selected by appropriate dimensioning of the abutment 36 to ensure that there is a continuous, smoothly curved surface 43 over the entire width of the arm rearwardly of the edge 46 against which the male blade can slide. The width dimension W, FIG. 7, of the channel is made slightly greater than the width dimension V of the abutment to ensure that the laterally spaced tip portions 44 can clear each side of the abutment upon insertion of the contact into the pocket with the tips leading in the direction of insertion.

If desired, the abutment 36 may continue forwardly from the point P and follow the same general slope of the rearward portion thereof, to a point adjacent the front end 35 of the pocket. In such case, the abutment resembles, in side elevation, the abutment illustrated in FIG. 3.

Figure 3:
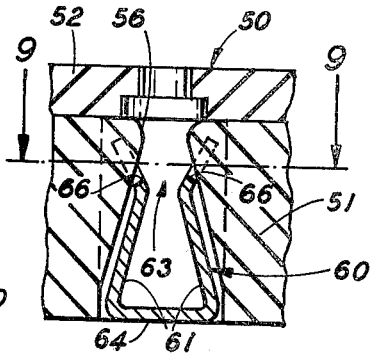
FIG. 3 is a sectional side view along a longitudinal plane passing through both arms of another embodiment of a female contact assembly constructed in accordance with this invention.
Figure 4:
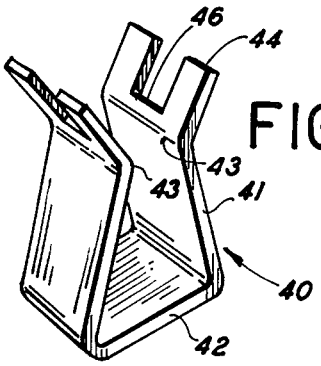
FIG. 4 is an isometric view of the female contact illustrated in FIG. 2.
Figure 9:
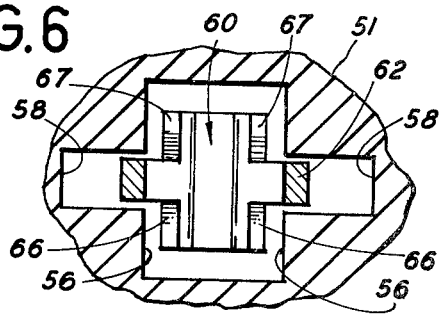
FIG. 9 is a sectional plan view taken along section lines 9—9 of FIG. 3.

With reference to FIG. 3, there is shown another embodiment 50 of a contact assembly constructed in accordance with this invention. The assembly 50 comprises a pocket sidewall 51 having the abutment 56 of rectangular cross-sectional shape which extends from the rearward to the frontward end of the pocket and terminates adjacent the front cover 52 to define an entrance into the female contact arms 61 of contact 60. The inner edge of each abutment 56 is inclined at an acute angle to the contiguous sidewall 51 from which the abutment projects so as to be substantially parallel to a substantial length of the opposing contact arm between contact base 64 and knee region 63. The arms 61 of contact 60 are each channeled to provide two aligned shoulders 66 and 67, respectively, having a rectangular tip 62 located midway therebetween and extending at right angles from the shoulders. The tip 62 fits with a clearance into a U-shaped slot 58 formed in the abutment 56. The depth of each slot 58, FIG. 9, is sufficient to allow outward displacement of the opposite contact arm tip 62 at least until the outer surface of an arm 61 is driven against the abutment 56. The two channels formed by the shoulders 66 and 67 and their respective adjacent edges of the tip 62 are dimensioned as described in connection with the embodiment of FIG. 2 to permit the shoulders 66 and 67 to pass over the inner surfaces of the abutments 56 upon insertion of the contact into the pocket of the assembly 50. As illustrated, the shoulders 66 and 67 are typically of equal width and the tip 62 has a width slightly less than that of the slot 58 in order to clear the slot.

In the embodiments described hereinabove, by locating the bottom edges of the channels forwardly of the knee region, once the tip of the male contact blade rides onto the smooth surfaces of the knee portions it can be inserted into the female contact without interruption from the edges defining the channels. Also, the full width of the contact arms will be in electrical contact with the male contact blade in the knee region.

Should it be desired to increase the clearance between the abutment and the contact arms and the flexibility of the tip portions, the depth to which the tips are channeled may be increased. The tips may be channeled, and hence the dimension X+Y increased, until the bottom edge 46 is located at or rearwardly of the knee portions 43. This latter construction has the advantage that male contacts with burred or rough tip edges will pass the knee portions 43 and separate them fully before reaching the more rearward bottom edges 46. Because the edges 46 are displaced outwardly of the male blade tip with respect to the knee portions, there is little opportunity for the male blade tip to hang up on either of these edges upon the further insertion of the male tip into the contact.

Figure 10:
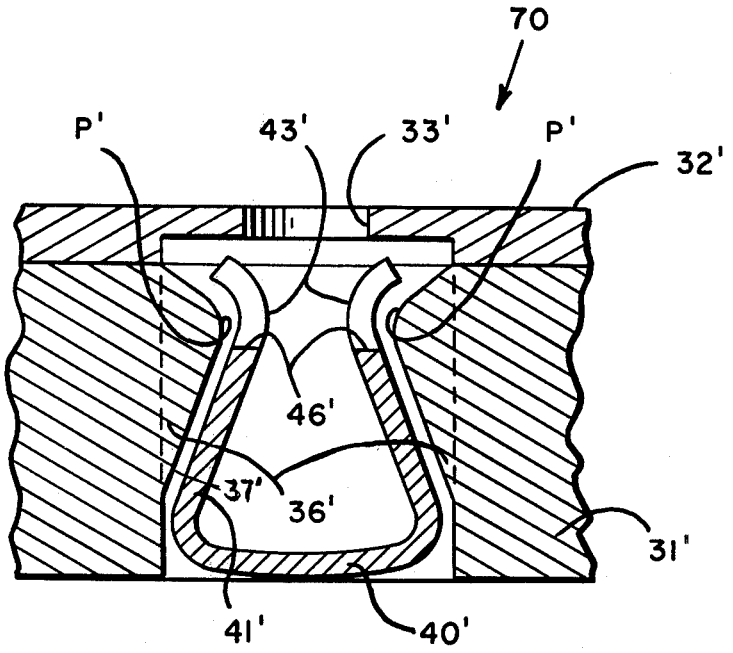
FIG. 10 is a sectional side view along a longitudinal plane passing through both arms of another embodiment of a female contact assembly constructed in accordance with the principles of this invention.
Figure 11:
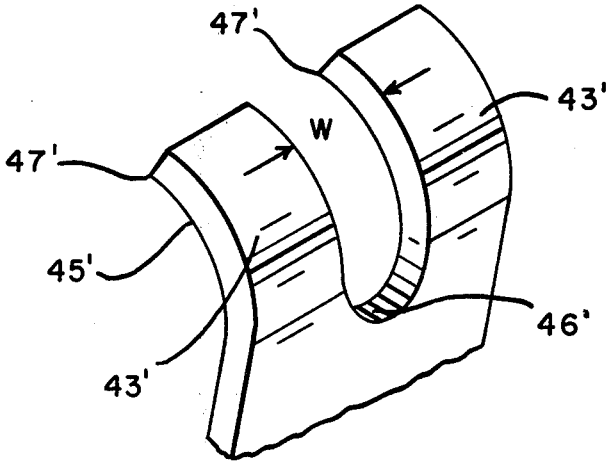
FIG. 11 is an isometric view of the frontward end of the left arm of the female contact shown in FIG. 10.

FIGS. 10 and 11 illustrated another embodiment of a female contact assembly 70 wherein the bottom edge of the channel is located rearwardly of the knee region. Inasmuch as this embodiment may be similar to the embodiment illustrated in FIG. 2, similar parts in FIGS. 10 and 11 are referred to by the same numerals but are distinguished in FIGS. 10 and 11 by the addition of prime notations thereto.

As illustrated in FIG. 10, the contact terminal pocket of the assembly 70 includes two spaced-apart mutually opposing sidewalls 31' which join with two other spaced-apart, mutually opposing sidewalls to form a terminal pocket of substantially rectangular cross-sectional shape. A front cover 32' partially encloses the frontward end of the sidewalls and has a conventional opening 33' extending therethrough for receiving the blade of a conventional male contact which may have various cross-sectional shapes such as circular, U-shaped or rectangular.

Each of the two mutually opposing abutments 36' follow along the same general curvature of an overlying portion of an opposing contact arm 41' and each abutment is spaced from such portion to define the permissible limit of outward displacement of its associated contact arm. The innermost point of each abutment 36' is designated P' and each point P' is directly opposite the back of a contact knee 43' of an overlying contact arm 41'. The channel formed in the frontward end of each arm, as best seen in FIG. 11, has a width W which is slightly greater than the width of its underlying abutment 36'.

Each channel is blanked or cut to a depth which extends to the knees 43', or rearwardly of the knees as shown in FIG. 11. By having the channels extend rearwardly of the knees 43', the bottom edge 46' of the channel is rearwardly and outwardly of the knees. Hence, the bottom edges of the channels are intitially out of line with the path of the male contact tip during its insertion and therefore, the possibility of the bottom channel edges interrupting the blade are reduced. Moreover, the tip of the male contact will initially engage and force the knees 43' apart before reaching the edge 46'. Hence, each edge 46' will also be displaced outwardly before the male contact tip reaches that edge. As mentioned above, should the male contact tip have an outwardly projecting surface irregularity, such as a metal burr or cutting, the outward displacement of the edges 46' will lessen the chance that an irregularity will hang up on one of the edges and obstruct the further insertion of the male blade into the assembly 70.

With the edges 46' rearwardly of the knee portions, the greater length of the channel decreases the chance that the bottom channel edge will be obstructed by an inwardly inclined abutment edge 37' when the contact 40' is inserted into the pocket and increases the capability of the tips to flex inwardly and pass over an abutment edge 37' without taking a permanent set.

As will be apparent to those in the art, the female contact assembly of this invention may be oriented about its longitudinal axis to provide optimum guidance of the male blade into the knee region and to establish the desired electrical interface between the male blade and the assembly. Thus, with a male blade tip of U cross-sectional shape, the female contact assembly can be oriented so that each of the two parallel leg portions of the U ride against one of the opposing contact arms with the arcuate portion of the U transverse to the opposing surfaces of the tips.

Other embodiments of this invention will readily suggest themselves to those skilled in the art and therefore, various changes and modifications can be made therein without departing from the scope of the invention as defined in the appended claims.

I claim as my invention:

1. A female electrical contact assembly having a contact pocket defined by a sidewall, a front end and a rear end, the front end having an opening therein for receiving a male contact, the pocket having a longitudinal axis and housing a female contact including a base member and at least one elongate contact arm having a rearward portion extending from the base member toward the front end of the pocket, the rearward portion of said contact arm being inclined inwardly from the base member toward said longitudinal axis to provide a region wherein electrical contact is made with the male contact inserted into the opening, a frontward portion of said contact arm diverging outwardly from the region to a position rearwardly of the opening for guiding the tip of the male contact into the region, wherein the improvement comprises; a contact arm abutment mounted on the pocket sidewall and having a part thereof opposite the contact arm and extending inwardly of said frontward portion thereof substantially in said region for restraining outward displacement of said contact arm, said frontward portion of said contact being open to pass said abutment part when the contact arm is inserted into the pocket through the rear end thereof with the frontward contact portion leading the rearward contact portion.

2. The assembly as claimed in claim 1 wherein said abutment has a longitudinal cross-section of substantially triangular shape.

3. The assembly as claimed in claim 1 wherein said contact arm abutment is a unitary part of the pocket sidewall.

4. The assembly as claimed in claim 3 wherein said abutment comprises, a rib member extending inwardly adjacent said contact arm from a sidewall of the contact pocket.

5. The assembly as claimed in claim 4 wherein a channel is formed in said contact arm adjacent said frontward portion thereof in substantial alignment with said rib member when said contact arm is inserted into the contact pocket, said channel allowing said contact arm to pass said rib member.

6. The assembly as claimed in claim 5 wherein the innermost surface of said rib member extends progressively further inward in a direction from the rear to the front ends of the pocket.

7. The assembly as claimed in claim 6 wherein the inwardmost part of the rib member is opposite said region of said contact arm.

8. The assembly as claimed in claim 6 wherein the inwardmost part of said rib member is proximate the male blade opening.

9. The assembly as claimed in claim 6 wherein the inwardmost surface of said abutment follows substantially the contour of the adjacent outer surface of the contact arm.

10. The assembly as claimed in claim 5 wherein said channel extends rearwardly from the frontward portion of said contact arm to a location adjacent said region.

11. The assembly as claimed in claim 10 wherein said channel is formed in one side edge of said contact arm.

12. The assembly as claimed in claim 10 wherein said channel is formed between opposite side edges of said contact arm.

13. The assembly as claimed in claim 5, wherein first and second edges intersect to at least partially define said channel, the first edge lying in a plane substantially parallel to the plane of one edge of said rib member and spaced therefrom in a direction perpendicular to said longitudinal axis so as to provide clearance to relative movement therebetween, said contact arm having an arcuate surface portion defining said region, the second edge located forwardly at, or rearwardly of said arcuate surface portion and extending laterally from said first edge transverse to said rib member a distance at least equal to the corresponding dimension of said rib member.

14. The assembly as claimed in claim 13 wherein said channel is further defined by a third edge, said third edge being substantially parallel and coextensive to said first edge, said second edge extending laterally between said first and third edges, the lateral spacing between said first and third edges being less than the lateral dimension between the opposite edges of said tip which are in substantial alignment with said second edge, said lateral dimension being slightly greater than the corresponding lateral dimension of said rib member.

15. The assembly as claimed in claim 14 wherein said first and third edges are substantially parallel to adjacent respective edges of said contact arm and said second edge is substantially perpendicular to said first and third edges.

16. The assembly as claimed in claim 14 wherein said first and third edges terminate at the frontwardmost tip end of said male contact.

17. The assembly as claimed in claim 16, wherein said first and third edges are located substantially equal distances from respective adjacent edges of said tip.

18. The assembly as claimed in claim 13 wherein said first and second edges intersect at substantially right angles.

19. The assembly as claimed in claim 18 wherein said second and third edges intersect at substantially right angles.

20. The assembly as claimed in claim 13 wherein said first surface is substantially parallel to an adjacent edge of said contact arm.

21. The assembly as claimed in claim 20 wherein said second surface is substantially perpendicular to said edge of said contact arm.

22. A female electrical contact assembly having a contact pocket defined by a sidewall, a front end and a rear end, the front end having an opening therein for receiving a male contact, the pocket housing a female contact including a base member and at least one elongate contact arm having a rearward portion extending from the base member toward the front end of the pocket, the rearward portion of said contact arm being inclined inwardly from the base member to provide a region wherein electrical contact is made with the male contact inserted into the opening, a frontward portion of said contact arm diverging outwardly from the region for guiding the tip of the male contact into the region, wherein the improvement comprises; a contact arm abutment mounted on the pocket sidewall opposite and adjacent the contact arm and extending inwardly of said frontward portion of said arm for restraining outward displacement of said arm, said frontward portion of said arm being recessed to pass said abutment when the contact arm is inserted into the pocket through the rear end thereof with the frontward contact portion leading the rearward contact portion.

23. The assembly according to claim 22 wherein there are a pair of elongated female contact arms having portions in said region and frontward thereof of substantially identical configuration, said arms mounted in said contact pocket in mutually opposing relationship, and wherein a pair of abutments of substantially identical configurations are formed as integral parts of opposing pocket sidewalls, each of said female contacts having a recess for passing over a part of a corresponding one of said abutments upon insertion of said arms in said pocket.

24. The assembly according to claim 23 wherein the portions of said contact arms immediately frontward of said region are smooth surfaces against which the tip of a contact can slide without interruption into said region.

25. A female contact assembly comprising, at least two opposing sidewalls composed of an electrical insulating material and providing a cavity having two oppositely disposed ends and a longitudinal axis, one end of said cavity having an aperture to receive a male contact, an electrically conductive contact mounted in the cavity, said contact having a free tip end thereof adjacent said one end of the cavity, said tip end diverging outwardly of said longitudinal axis for guiding a male contact blade inserted into the aperture at said one end of the cavity, a portion of one of said sidewalls projecting inwardly from the one sidewall toward said longitudinal axis and spaced from an opposing portion of said contact for defining the permissible outward displacement of said opposing portion of said contact, said portion of said one sidewall having a width dimension perpendicular to the longitudinal axis of the cavity, said tip end of said contact having a recess with a width dimension perpendicular to the longitudinal axis of the cavity which is greater than the width dimension of the one sidewall portion and a length dimension parallel to said axis which is greater than the amount of inward projection of said one sidewall portion opposite said tip end so that said tip end can pass said sidewall portion upon its longitudinal insertion into the cavity from the cavity end opposite said one end of the cavity, said tip end of said contact extending outwardly of said one sidewall portion both prior to, and with, the male blade being inserted into the cavity.

26. A female contact assembly comprising, at least two opposing sidewalls composed of an electrical insulating material and providing a cavity having two opposite ends and a longitudinal axis, one end of said cavity having an aperture to receive a male contact, an electrically conductive contact mounted in the cavity, said contact comprising a pair of elongated contact blades joined together at one end thereof and disposed substantially symmetrically with respect to said longitudinal axis, each of said blades having a free tip at the other end thereof adjacent said one end of the cavity, said tips being spaced apart to define a gap therebetween into which the male contact is inserted and diverging outwardly of said longitudinal axis for guiding the male contact blade inserted into said aperture, a rib formed on each one of said sidewalls and projecting inwardly thereof toward said longitudinal axis, the ribs positioned opposite one another and each rib being spaced adjacent an opposing portion of one of said contact blades for limiting the outward displacement of its associated contact blade, each of said ribs having a width dimension perpendicular to the longitudinal axis of the cavity, the tips of each of said contacts having a slot formed therein, each slot having a width dimension perpendicular to the longitudinal axis of the cavity which is greater than the width dimension of its opposing rib and length dimensions parallel to said axis which is a function of the amount of inward projection of the rib portions opposite said tips whereby said tips can pass by said ribs upon the longitudinal insertion of the contact into the cavity from the cavity end opposite said one end of the cavity.

27. The female contact assembly as claimed in claim 26, wherein a portion of each contact blade is inclined inwardly toward said longitudinal axis substantially from said one end thereof to form a knee region therebetween where electrical contact is established with the male contact, and wherein said tips diverge outwardly from said knee region to a location adjacent the aperture.

28. The female contact assembly as claimed in claim 27 wherein each slot has a length dimension which extends from the tip to the inwardly inclined portion of each blade.

* * * * *